US008247997B2

(12) United States Patent
Liess et al.

(10) Patent No.: US 8,247,997 B2
(45) **Date of Patent: *Aug. 21, 2012**

(54) BALLAST WITH LAMP FILAMENT DETECTION

(75) Inventors: Uwe Liess, Treviso (IT); Naveen Yadlapalli, Billerica, MA (US)

(73) Assignee: OSRAM SYLVANIA Inc., Danvers, MA (US)

( * ) Notice: Subject to any disclaimer, the term of this patent is extended or adjusted under 35 U.S.C. 154(b) by 2 days.

This patent is subject to a terminal disclaimer.

(21) Appl. No.: 12/993,220

(22) PCT Filed: Jun. 23, 2009

(86) PCT No.: PCT/US2009/048236

§ 371 (c)(1),
(2), (4) Date: Nov. 17, 2010

(87) PCT Pub. No.: WO2009/158330

PCT Pub. Date: Dec. 30, 2009

(65) Prior Publication Data

US 2011/0062878 A1 Mar. 17, 2011

Related U.S. Application Data

(60) Provisional application No. 61/076,039, filed on Jun. 26, 2008.

(51) Int. Cl.

| | |
|---|---|
| ***G05F 1/00*** | (2006.01) |
| ***H05B 37/02*** | (2006.01) |
| ***H05B 39/04*** | (2006.01) |
| ***H05B 41/36*** | (2006.01) |
| *H05B 41/16* | (2006.01) |
| *H05B 41/24* | (2006.01) |

(52) U.S. Cl. ..... 315/294; 315/210; 315/226; 315/250; 315/307

(58) Field of Classification Search ..... None
See application file for complete search history.

(56) References Cited

U.S. PATENT DOCUMENTS 5,973,455 A * 10/1999 Mirskiy et al. ..... 315/105

(Continued)

FOREIGN PATENT DOCUMENTS

JP 11-162677 A 6/1999

(Continued)

OTHER PUBLICATIONS

Chang Gyun Kim, PCT International Search Report for PCT/US09/48236, Feb. 1, 2010, pp. 1-3, Korean Intellectual Property Office, Daejeon, Republic of Korea.

(Continued)

*Primary Examiner* — Douglas W Owens
*Assistant Examiner* — Dedei K Hammond
(74) *Attorney, Agent, or Firm* — Shaun P. Montana

(57) ABSTRACT

A ballast (10) for powering one or two gas discharge lamps (30,40) includes an inverter (100), an output circuit (200), and a control circuit (500). During a period prior to startup of inverter (100), control circuit (500) monitors a signal within output circuit (200) in order to determine the presence of lamps with intact filaments that are present at the ballast output connections (202,204, . . . ,210,212). Preferably, control circuit (500) is realized by a programmable microcontroller which implements a dual timing scheme in order to accurately determine the number of lamps with both filaments intact. The resulting determination may be used for various purposes, such providing appropriate levels of filament heating and/or for setting thresholds for accurately detecting and protecting against various lamp fault conditions.

16 Claims, 5 Drawing Sheets

U.S. PATENT DOCUMENTS 7,183,714 B1 2/2007 Choudhury

FOREIGN PATENT DOCUMENTS

| | | | |
|---|---|---|---|
| JP | 11-242998 | A | 9/1999 |
| JP | 2002-299089 | A | 10/2002 |
| JP | 2002-324689 | A | 11/2002 |
| JP | 2004-087328 | A | 3/2004 |
| JP | 2008-016393 | A | 1/2008 |
| WO | 2005-060320 | A1 | 6/2005 |

OTHER PUBLICATIONS

Chang Gyun Kim, PCT Written Opinion of the International Searching Authority for PCT/US09/48236, Feb. 1, 2010, pp. 1-3, Korean Intellectual Property Office, Daejeon, Republic of Korea.

* cited by examiner

BALLAST WITH LAMP FILAMENT DETECTION

CROSS-REFERENCE TO RELATED APPLICATIONS

The present application claims priority of PCT International Application Serial No. PCT/US09/48236, filed Jun. 23, 2009, which claimed priority to U.S. Provisional Patent Application Ser. No. 61/076,039, filed Jun. 26, 2008, the entire contents of both of which are hereby incorporated by reference.

The present application is related to corresponding PCT International Application Serial No. PCT/US09/48247, filed June 23, 2009 and "entitled Ballast with Lamp-Diagnostic Filament Heating, and Method Therefor", which is owned by the same Assignee and has the same inventors as the present application, and which claimed priority to U.S. Provisional Patent Application Ser. No. 61/076,051, and which has entered the National Stage in the U.S. as U.S. Application Ser. No. 12/993 223, filed on Nov. 17, 2010. The entire contents of all three of these related applications are hereby incorporated by reference.

TECHNICAL FIELD

The present invention relates to the general subject of circuits for powering gas discharge lamps. More particularly, the present invention relates to a ballast that includes circuitry for detecting the presence of lamps with intact filaments.

BACKGROUND

In an electronic ballast for powering gas discharge lamps, it is preferred that the ballast be capable of detecting the presence of functional lamps (i.e., lamps having both filaments intact and being in operational condition) at the ballast output connections. Such detection is useful, for example, in allowing the ballast to provide an appropriate level of heating to the filaments of the lamps, and may also be utilized to provide the ballast with enhanced capabilities for more accurately detecting various types of lamp fault conditions.

A number of existing programmed-start type ballasts utilize a direct current (DC) path through the lamp filaments to provide startup current to a driver circuit for the ballast inverter, thereby ensuring that the inverter will start only if at least one lamp with intact filaments is present at the output connections of the ballast. This approach works well in certain cases, but is often plagued by the problem of excessive power dissipation, especially in those applications for which the starting current requirements of the driver circuit are relatively high; in those cases, the DC path necessarily has a relatively low impedance (to allow higher current flow for meeting the starting current requirements of the driver circuit) which, during steady-state operation of the ballast, results in considerable power dissipation and thus significantly detracts from the overall energy efficiency of the ballast. Accordingly, a need exists for an alternative approach for detecting the presence of functional lamps (i.e., lamps with both filaments intact) that does not entail significant additional power dissipation within the ballast.

Ballasts with driven type inverters usually include some form of protection circuitry for protecting the ballast from excessive power dissipation and/or damage in the event of a lamp fault condition (e.g., removal or failure of one or more lamps). Such protection circuitry typically utilizes certain predetermined voltage thresholds in order to determine whether or not a lamp fault condition is present. In some ballasts, the protection circuitry is designed to accommodate relamping (i.e., replacement of a failed lamp with a new lamp) without requiring that the input power to the ballast be cycled (i.e., the power switch being turned off and then on again) in order to ignite and operate the new lamp. For ballasts that include protection circuitry, it is helpful for the ballast to be able to ascertain, prior to lamp ignition, the presence of lamps with intact filaments connected at the ballast outputs, so as to establish appropriate voltage thresholds for determining whether or not a lamp fault condition is indeed present.

Therefore, a need exists for a ballast that is capable of detecting the presence of lamps with intact filaments in a reliable, cost-effective, and energy-efficient manner. Such a ballast would be capable of providing a number of benefits, including more appropriate levels of filament preheating as well as more accurate detection of lamp fault conditions, and would thus represent a considerable advance over the prior art.

DETAILED DESCRIPTION

Figure 1:
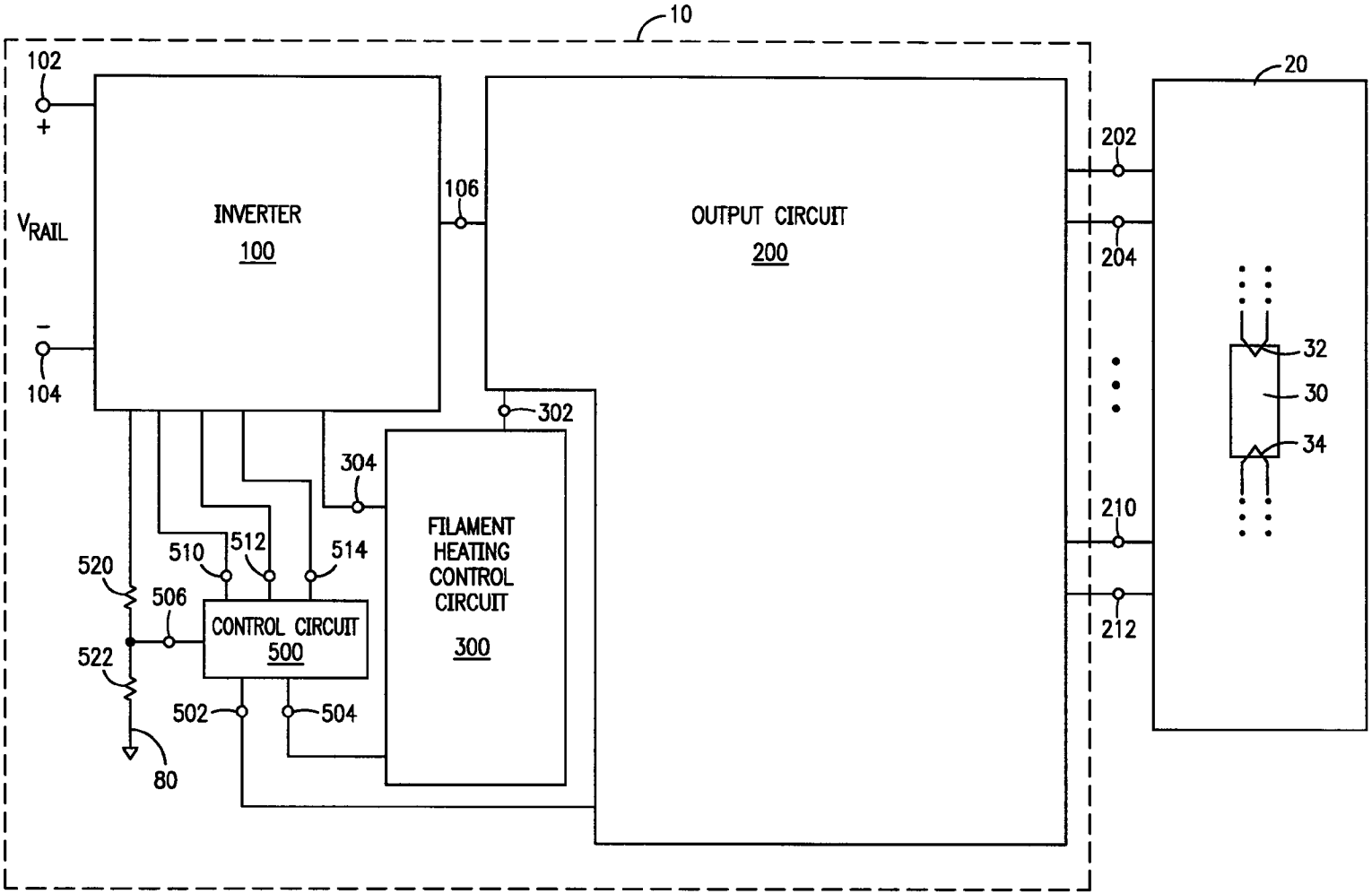
FIG. 1 is a partial block-diagram schematic of a ballast with lamp filament detection, in accordance with a preferred embodiment of the present invention.

FIG. 1 shows a block diagram of a resonant inverter 100 including a control IC 103 and a sleep circuit.

FIG. 1 describes a ballast 10 for powering a gas discharge lamp load 20. Lamp load 20 includes at least one gas discharge lamp 30 having a pair of lamp filaments 32,34. Ballast 10 comprises an inverter 100, an output circuit 200, and a control circuit 500.

Figure 2:
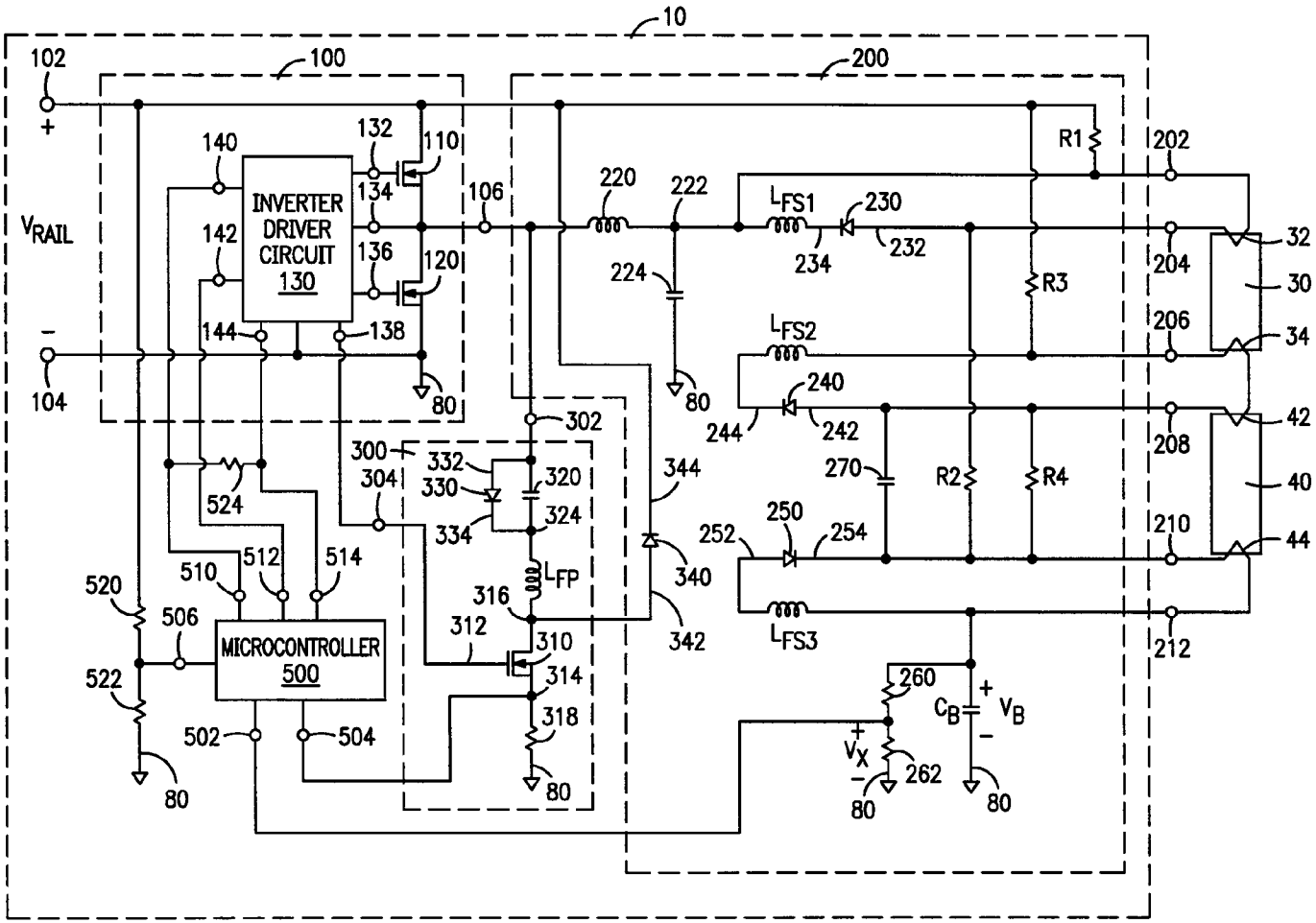
FIG. 2 is a circuit diagram of a ballast for powering two lamps that includes lamp filament detection, in accordance with a preferred embodiment of the present invention.
Figure 3:
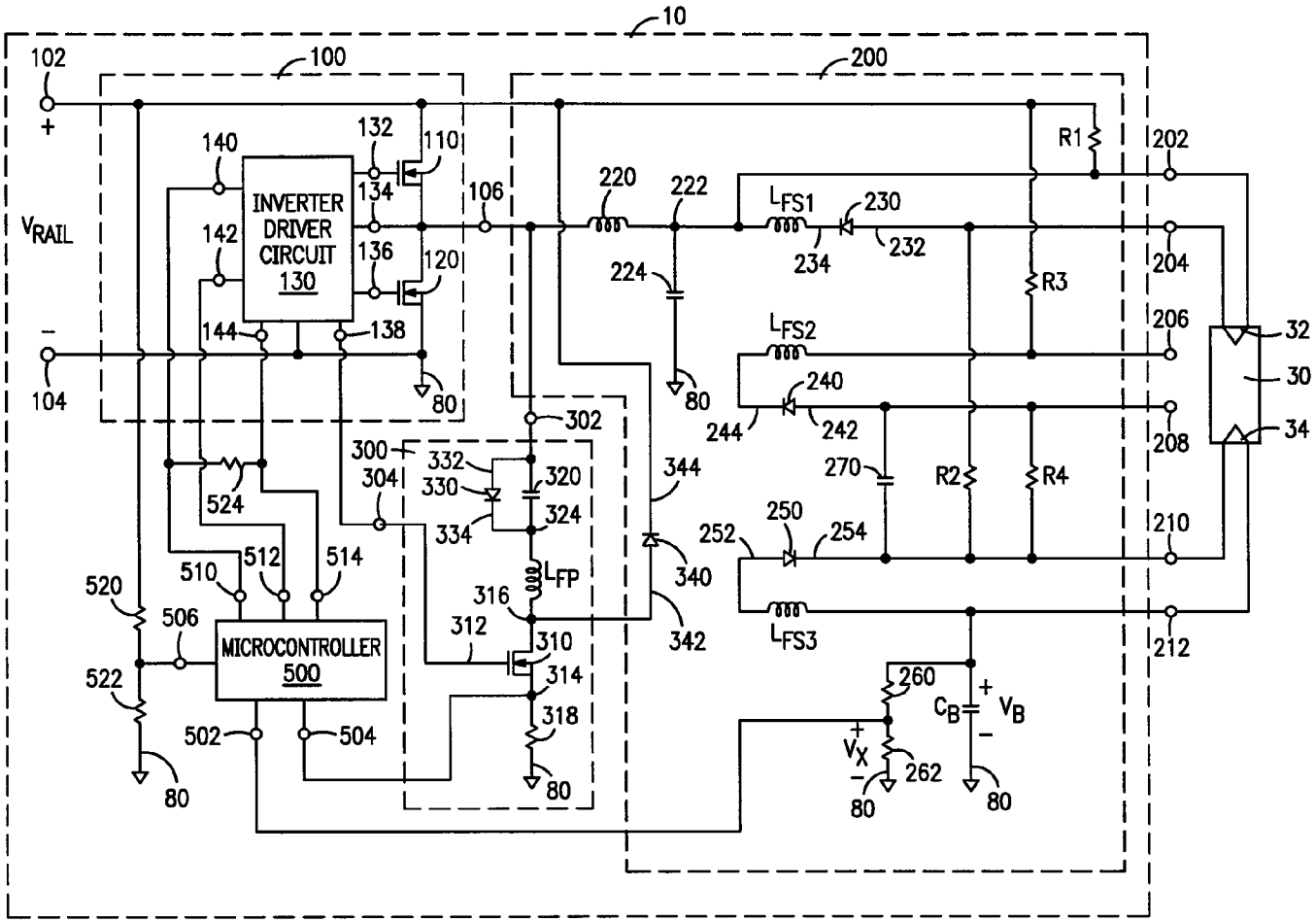
FIG. 3 is a circuit diagram of the ballast of FIG. 1, wherein the ballast is utilized to power only a single lamp, in accordance with a preferred embodiment of the present invention.

Ballast 10 preferably further includes a filament heating control circuit 300 that is coupled to output circuit 200 (via a first input 302), inverter 100 (via a second input 304), and control circuit 500 (via an input 504 of control circuit 500). A preferred structure (as depicted in FIGS. 2 and 3 herein) for realizing filament heating control circuit 300 is described in further detail in the aforementioned U.S. patent application Ser. No. titled "Ballast with Lamp-Diagnostic Filament Heating, and Method Therefor."

Referring again to FIG. 1, inverter 100 includes first and second input terminals 102,104 and an inverter output terminal 106. First and second input terminals 102,104 are adapted to receive a source of substantially direct current (DC) voltage, $V_{RAIL}$, such as that which is commonly provided by a combination of a full-wave rectifier (powered from a conventional AC source—e.g., 277 volts at 60 hertz) and a DC-to-DC converter circuit (e.g., a boost converter). $V_{RAIL}$ is typically selected to have a steady-state operating magnitude that is on the order of several hundred volts; for example, for a commonly provided AC source voltage of 277 volts rms, $V_{RAIL}$ is typically selected to have a steady-state operating magnitude of about 450 volts. During operation, inverter 100 provides an alternating output voltage (typically selected to have a frequency in excess of 20,000 hertz) at inverter output terminal 106. The operational details of inverter 100 are known to those skilled in the art, and will not be discussed in detail herein. A preferred detailed structure for realizing inverter 100 is described herein with reference to FIGS. 2 and 3.

Output circuit 200 is coupled to inverter 100 and includes a plurality of output connections 202,204, . . . ,210,212 adapted for coupling to one or more lamps within lamp load 20. During operation, output circuit 200 receives the alternating output voltage at inverter output terminal 106 and provides a high voltage for igniting, and a magnitude-limited current for operating, the lamp(s) within lamp load 20. Additionally, output circuit 200 serves, in conjunction with filament heating control circuit 300, to provide appropriate levels of excitation for heating the filaments of the lamp(s) within lamp load 20. A preferred structure for realizing output circuit 200 is described herein with reference to FIGS. 2 and 3.

Control circuit 500 is coupled to inverter 100 and output circuit 200. During operation, and in a detection period (i.e., in the time between when power is applied to ballast 10 and when inverter 100 begins to operate), control circuit 500 detects whether or not one or more lamps with intact lamp filaments are coupled to output connections 202, 204, . . . ,210,212. More specifically: (1) in an arrangement wherein two lamps are coupled to the output connections, control circuit 500 detects whether or not both of the lamps have both filaments intact; and (2) in an arrangement wherein only a single lamp is coupled to the output connections, control circuit 500 detects whether or not the single lamp has both filaments intact.

Thus, control circuit 500 operates to determine the presence of lamps with intact filaments that are connected to ballast 10. This determination may be utilized in any of a number of ways, such as for providing appropriate filament heating voltages, for setting/adjusting thresholds that are used for detecting lamp fault conditions, and/or for accommodating relamping.

As described in FIG. 1, control circuit 500 includes a filament detection input 502 and a plurality of control outputs 510,511,512. Filament detection input 502 is coupled to output circuit 200, while control outputs 510,511,512 are coupled to inverter 100.

During operation, in the detection period prior to startup of inverter 100, as well as during a subsequent shutdown and/or monitoring mode, control circuit 500 receives, at filament detection input 502, a voltage signal from output circuit 200 that indicates whether or not one or two lamps with intact lamp filaments are coupled to output connections 202,204, . . . ,210,212. Control circuit 500 provides a digital control signal at control outputs 510,511,512 in dependence upon the voltage signal provided to filament detection input 502. More specifically, control circuit 500 provides a digital control signal at control output 512 which is then provided to inverter 100 in dependence upon the voltage signal provided to filament detection input 502. Additionally, control circuit 500 provides digital control signals at control outputs 510,511 which are received by inverter 100 and which are utilized by inverter 100 to control the timing of the commutation of one or more electronic switches (e.g., power transistors) within inverter 100 and heating control circuit 300.

In a preferred embodiment of ballast 10, as described in FIGS. 2 and 3, control circuit 500 is realized by a suitable programmable microcontroller, such as the ST7LITE1B micro-controller integrated circuit manufactured by ST Microelectronics. In the following description, control circuit 500 is hereinafter referred to as microcontroller 500.

FIGS. 2 and 3 describe a preferred detailed structure for ballast 10 that is suitable for powering either two lamps (FIG. 2) or a single lamp (FIG. 3). It should be appreciated that microcontroller 500 is capable, provided that all filaments of the associated lamp(s) are intact, of distinguishing between the two-lamp arrangement of FIG. 2 and the one-lamp arrangement of FIG. 3. Consequently, the preferred embodiment of ballast 10 may be used to power a lamp load consisting of either two lamps or a single lamp. It should also be appreciated that the principles of the present invention are not limited to arrangements consisting of one or two lamps, but may be extended to arrangements that include three or more lamps.

Referring to FIG. 2, inverter 100 is preferably realized as a driven half-bridge type inverter comprising first and second inverter switches 110,120 (preferably realized by N-channel field-effect transistors, as depicted in FIG. 2) and an inverter driver circuit 130. During operation, inverter driver 130 receives (at inputs 140,141) logic-level (i.e., low voltage) control signals from microcontroller 500 and, in response, commutates inverter switches 110,120 (via suitable drive signals provided at outputs 132,134,136) in a substantially complementary fashion (i.e., such that when transistor 110 is turned on, transistor 120 is turned off, and vice-versa) and at a high frequency rate that is typically selected to be greater than 20,000 hertz. Preferably, and as will be appreciated by those skilled in the art, the control signals provided at outputs 510,511 of microcontroller 500 (which control signals are received by inverter driver circuit 130 via inputs 140,141) dictate the timing of the commutation of FETs 110,120; inverter driver circuit 130 effectively amplifies and level shifts those control signals so as to provide appropriate drive signals for turning FETs 110,120 on and off in a desired and efficient manner.

During operation of inverter 100, the output voltage that is provided at inverter output terminal 106 is a substantially squarewave voltage that, taken with respect to circuit ground 80, periodically varies between the magnitude of $V_{RAIL}$ and zero. Inverter driver circuit 130 may be realized by any of a number of suitable circuits or devices known to those skilled in the art, such as the L6382D5 integrated circuit manufactured by ST Microelectronics. Alternatively, inverter driver circuit 130 may be realized by any of a number of discrete circuit arrangements that are known to those skilled in the art.

As described in FIG. 2, inverter driver circuit 130 preferably includes a plurality of inputs 140,141,142 and a plurality of outputs 132,134,136,138. The signals at inputs 140,141, 142 and at outputs 132,134,136,138 are described as follows.

Input 140 of inverter driver circuit 130 is coupled to control output 510 of microcontroller 500; the signal at input 140 is used to control the commutation of inverter FET 110. More specifically, the logic-level (i.e., low voltage) signal provided at output 510 of microcontroller 500 is received at input 140 and is processed (i.e., amplified and/or level-shifted) by inverter driver circuit 130 so as to provide an output signal, between outputs 132,134, having a magnitude and power level that is sufficient for commutating FET 110 in a desired and reliable manner.

Along similar lines, input 141 of inverter driver circuit 130 is coupled to control output 511 of microcontroller 500; the signal at input 141 is used to control the commutation of inverter FET 120. More specifically, the logic-level (i.e., low voltage) signal provided at output 511 of microcontroller 500 is received at input 141 and is processed (i.e., amplified and/or level-shifted) by inverter driver circuit 130 so as to provide an output signal, between output 136 and circuit ground 80, having a magnitude and power level that is sufficient for commutating FET 120 in a desired and reliable manner.

Referring again to FIG. 2, input 142 of inverter driver circuit 130 is coupled to output 512 of microcontroller 500 and output 510 of microcontroller 500 via resistor 524. More specifically, the logic-level (i.e., low voltage) signal provided at outputs 510 and 512 of microcontroller 500 is received at input 142 and is processed (i.e., amplified and/or level-shifted) by inverter driver circuit 130 so as to provide an output signal, between output 138 and circuit ground 80, having a magnitude and power level that is sufficient for commutating an electronic switch (e.g., FET 310) within filament heating control circuit 300 in a desired manner. Further details concerning the operation of filament heating control circuit 300 are disclosed in the aforementioned U.S. patent application Ser. No. titled "Ballast with Lamp-Diagnostic Filament Heating, and Method Therefor."

In the preferred low-cost arrangement described with reference to FIG. 2, wherein microcontroller 500 is preferably realized by a device such as the ST7LITE1B integrated circuit (manufactured by ST Microelectronics), a resistor 524 is coupled between control outputs 510,512 of microcontroller 500. Resistor 524 is utilized so that the signal (at output 512 of microcontroller 500) for controlling commutation of FET 310 (within filament heating control circuit 300) is substantially synchronized with the signal (provided at output 510 of micro-controller 500) for controlling commutation of inverter FET 110. In this preferred arrangement, output 512 of microcontroller 500 is configured as a so-called "open drain output" so as to allow for deactivation of filament heating control circuit 300 (i.e., keeping FET 310 turned off) in response to a digital signal.

As will be appreciated by those skilled in the art, the aforementioned preferred arrangement, wherein microcontroller 500 provides (at outputs 510,511,512) logic-level signals and inverter driver circuit 130 provides drive-level signals (i.e., signals, at outputs 132,136,138, having magnitudes and power levels that are sufficient for commutating power transistors in a desired manner), allows ballast 10 to be realized in a cost-effective manner. The preferred arrangement may be compared with a even more desirable alternative arrangement wherein the signal for commutating FET 310 is directly (as opposed to indirectly derived from control signal at output 510 of microcontroller 500) provided by microcontroller 500; such an alternative arrangement necessitates the incorporation of a more complex timer unit for generating the 3 control signals 510,511,512 (e.g., pulse-width modulation generators) within microcontroller 500, which is at the time of the invention not available in the market for a reasonable cost allowing for a low-cost solution.

Referring again to FIG. 2, output circuit 200 is preferably realized as a series-resonant type output circuit comprising first, second, third, fourth, fifth, and sixth output connections 202,204,206,208,210,212, a resonant inductor 220, a resonant capacitor 224, a direct current (DC) blocking capacitor $C_B$, first and second voltage divider resistors 260,262, a plurality of resistances R1,R2,R3,R4, a capacitor 270, and filament heating circuitry (comprising secondary windings $L_{FS1}$, $L_{FS2}$,$L_{FS3}$ and diodes 230,240,250). First and second output connections 202,204 are adapted for coupling to a first filament 32 of a first lamp 30. Third and fourth output connections 206,208 are adapted for coupling to a second filament 34 of first lamp 30 and a first filament 42 of second lamp 40; as illustrated in FIG. 2, second filament 34 of first lamp 30 and first filament 42 of second lamp 40 are effectively connected in series with each other in a preferred embodiment, so third and fourth output connections 206,208 are adapted for coupling to both filaments 34,42. Nonetheless other embodiments may use a parallel connection of second filament 34 of first lamp 30 and first filament 42 of second lamp 40. Fifth and sixth output connections 210,212 are adapted for coupling to a second filament 44 of second lamp 40. Resonant inductor 220 is coupled between inverter output terminal 106 and a first node 222. Resonant capacitor 224 is coupled between first node 222 and circuit ground 80. DC blocking capacitor $C_B$ is coupled between sixth output connection 212 and circuit ground 80. First voltage divider resistor 260 is coupled between sixth output connection and voltage detection input 502 of microcontroller 500. Second voltage divider resistor 262 is coupled between voltage detection input 502 of microcontroller 500 and circuit ground 80. First resistance R1 is coupled between first input terminal 102 of inverter 100 and first output connection 202. Second resistance R2 is coupled between second output connection 204 and fifth output connection 210. Third resistance R3 is coupled between first input terminal 102 of inverter 100 and third output connection 206. Fourth resistance R4 and capacitor 270 are each coupled between fourth and fifth output connections 208,210.

Sequence start capacitor 270 coupled between output 208 and 210 in parallel to second lamp 40 will act as a capacitive voltage divider together with lamp leakage capacities and leakage capacitance of lamp wiring. This voltage divider is effecting the lamp voltages prior to striking of both lamps. Lamp voltage of lamp 30 will be much higher than lamp voltage of lamp 40 until lamp 30 strikes. After strike of lamp 30 nearly all output voltage of resonant output circuit 200 will be applied to lamp 40 and strike this lamp after lamp 30 in a sequential order.

Resistances R1,R2,R3,R4 (each of which may be realized by one or more resistors, as dictated by practical design considerations such as voltage and power ratings) collectively serve to allow microcontroller 500 to determine whether or not intact lamp filaments are connected to output connections 202,204,206,208,210,212. More particularly, in a detection period that occurs prior to startup of inverter 100 (i.e., before inverter 100 begins to operate and provide commutation of inverter switches 110,120), resistances R1,R2, R3,R4 (in conjunction with filaments 32,34,42,44 of lamps 30,40) provide filament current paths through which DC currents flow, provided that the associated lamp filaments are intact, into DC blocking capacitor $C_B$. In the two-lamp arrangement illustrated in FIG. 2, there are two distinct filament current paths; a first filament current path involves first filament 32 of first lamp 30 and second filament 44 of second lamp 40, and a second filament current path involves second filament 34 of first lamp 30, first filament 42 of second lamp 40, and second filament 44 of second lamp 40. In the one-lamp arrangement illustrated in FIG. 3, there is a single filament current path that involves first and second filaments 32,34 of lamp 30.

The filament heating circuitry within output circuit 200 comprises a plurality of series combinations including secondary windings $L_{FS1}$,$L_{FS2}$,$L_{FS3}$ and diodes 230,240,250. A series combination of secondary winding $L_{FS1}$ and diode 230 is coupled between first node 222 (which also connects to output 202) and second output connection 204; diode 230 has an anode 232 coupled to second output connection 204 and a cathode 234 coupled to $L_{FS1}$ thus blocking the DC path between output 202 and output 204 (except directly through the filaments as will be understood by those skilled in the art). The order of diodes and secondary windings within the series combination is determined by printed circuit board design considerations and may be swapped in other implementations. A series combination of secondary winding $L_{FS2}$ and diode 240 is coupled between third and fourth output connections 206,208; diode 240 has an anode 242 coupled to fourth output connection 208 and a cathode 244 coupled to $L_{FS2}$ thus blocking DC path between output 206 and 208. A series combination of secondary winding $L_{FS3}$ and diode 250 is coupled between fifth and sixth output connections 210,212; diode 250 has an anode 252 coupled to $L_{FS3}$ and a cathode 254 coupled to fifth output connection 210 thus blocking the DC path between output 210 and output 212. Secondary windings $L_{FS1}$,$L_{FS2}$,$L_{FS3}$ are each magnetically coupled to a primary winding $L_{FP}$ within filament heating control circuit 300. During operation, secondary windings $L_{FS1}$,$L_{FS2}$,$L_{FS3}$ provide heating of lamp filaments 32,34,42,44, and diodes 230,240, 250 serve to effectively isolate $L_{FS1}$,$L_{FS2}$,$L_{FS3}$ from the filament current paths provided by resistances R1,R2,R3,R4.

Further details concerning the preferred operation of secondary windings $L_{FS1}$,$L_{FS2}$,$L_{FS3}$ and filament heating control circuit 300 are provided in the aforementioned U.S. patent application Ser. No. titled "Ballast with Lamp-Diagnostic Filament Heating, and Method Therefor."

Resistances R1 and R2 together serve to provide the first filament current path that includes first filament 32 of first lamp 30 and second filament 44 of second lamp 40. That is, during operation of ballast 10 and in the period prior to startup of inverter 100, if filaments 32 and 44 are both intact, a first DC current flows from first inverter input terminal 102, through resistance R1, out of output connection 202, through filament 32, into output connection 204, through resistance R2, out of output connection 210, through filament 44, into output connection 212, through the parallel combination of capacitor $C_B$ and voltage divider resistors 260,262, and into circuit ground 80. The first DC current, taken by itself, contributes a voltage equal to $K_1*V_{RAIL}$ (where $K_1$ is a constant that is determined by the voltage divider formed by the resistances R1,R2 and resistors 260,262, the filament resistances within the current path are several magnitudes smaller than the other resistances and can therefore be neglected in calculating the constant $K_1$) to the voltage, $V_B$, that appears across DC blocking capacitor $C_B$ prior to startup of inverter 100.

Resistances R3 and R4 together serve to provide the second filament current path that includes second filament 34 of first lamp 30, first filament 42 of second lamp 40, and second filament 44 of second lamp 40. That is, during operation of ballast 10 and in the period prior to startup of inverter 100, if filaments 34, 42, and 44 are all intact, a second DC current flows from first inverter input terminal 102, through resistance R3, out of output connection 206, through filament 34, through filament 42, into output connection 208, through resistance R4, out of output connection 210, through filament 44, into output connection 212, through the parallel combination of capacitor $C_B$ and voltage divider resistors 260,262, and into circuit ground 80. The second DC current, taken by itself, contributes a voltage equal to $K_2*V_{RAIL}$ (where $K_2$ is a constant that is determined by the voltage divider formed by the resistances R3,R4 and resistors 260,262, and that is preferably chosen to be less than the constant $K_1$ associated with the first filament current path) to the voltage, $V_B$, that appears across DC blocking capacitor $C_B$ prior to startup of inverter 100. It should be appreciated that both the first and second filament current paths include second filament 44 of lamp 40 in this embodiment thereby providing safer conditions of operation.

When both the first and second filament current paths are intact (i.e., when filaments 32,34,42,44 are all intact), the voltage $V_B$ that appears across DC blocking capacitor $C_B$ prior to startup of inverter 100 is equal to $K_3*V_{RAIL}$ (where $K_3$ is a constant that is determined by the voltage divider formed by the resistances R1, R2, R3, R4 and resistors 260, 262). $K_3$ is therefore greater than constants $K_1$ and $K_2$ as a person skilled in the art would understand.

Voltage detection input 502 of microcontroller 500 is coupled to DC blocking capacitor $C_B$ via voltage divider resistors 260,262. More specifically, voltage detection input 502 is coupled to a junction of first voltage divider resistor 260 and second voltage divider resistor 262, and the series combination of first voltage divider resistor 260 and second voltage divider resistor 262 is coupled in parallel with capacitor $C_B$ (i.e., between sixth output connection 212 and circuit ground 80). It should be understood that the voltage $V_X$ across resistor 262 is simply a scaled-down version of the voltage $V_B$ across DC blocking capacitor $C_B$.

In a preferred embodiment of ballast 10, microcontroller 500 provides a first timing function (hereinafter referred to in connection with "the first timer") and a second timing function (hereinafter referred to in connection with "the second timer"). First timer and second timer are used by the microcontroller firmware to filter the measured voltage $V_X$ until one or both timers will overflow, thus incorporating digital filters to minimize noise influence on signal $V_X$. The time constants of the filter, which are basically the timer overflow thresholds multiplied with the sample time interval of signal $V_x$, are chosen higher than the time constant of the network formed by DC blocking cap $C_B$ and filament detection resistors R1,R2 and resistors 260 and 262. Microcontroller 500 utilizes the first and second timing functions to provide the following logic with respect to the voltage signal, $V_X$, received at voltage detection input 502 during the detection period.

1. If $V_B$ exceeds a first predetermined threshold, VTH1 (corresponding to $K_1*V_{RAIL}>V_{TH1}>K_2*V_{RAIL}$), but does not exceed a second predetermined threshold, $V_{TH2}$ (corresponding to $K_3*V_{RAIL}>V_{TH2}>K_1*V_{RAIL}$), the first timer is started and is periodically incremented at each sample time interval of voltage $V_x$ until such time as either: (i) $V_B$ exceeds $V_{TH2}$; or (ii) the first timer reaches a predetermined overflow limit (i.e., which means that $V_B$ has remained between $V_{TH1}$ and $V_{TH2}$ for a predetermined period of time, thereby indicating that only a single lamp with both filaments intact is coupled to the output connections).

2. If $V_B$ exceeds $V_{TH2}$ (corresponding to $K_3*V_{RAIL}>V_{TH2}>K_1*V_{RAIL}$, indicating that both the first and second filament paths are intact), the first timer is stopped, a second timer is started, and the second timer is periodically incremented at each sample time interval of voltage $V_x$ until such time as it reaches the predetermined overflow limit (i.e., which means that $V_B$ has remained above $V_{TH2}$ for a predetermined period of time, thereby indicating that two or more lamps with all filaments intact are coupled to the output connections).

3. If $V_B$ does not exceed a first predetermined threshold, $V_{TH1}$, indicating that no filament path is intact, first and second timer are periodically decremented to zero at each sample time interval of voltage $V_x$.

If the first timer reaches the predetermined overflow limit (which indicates the presence of a single lamp with both filaments intact, as in the arrangement described in FIG. 3), microcontroller 500 will enter preheat mode and select a prestored parameter set from internal memory suitable for driving inverter 100 and heating circuit 300 in a single lamp mode. If the second timer reaches the predetermined overflow limit (which indicates the presence of two lamps with both filaments of each lamp being intact, as in the arrangement described in FIG. 2), microcontroller 500 will enter preheat mode and select a prestored parameter set from internal memory suitable for driving inverter 100 and heating circuit 300 in a two lamp mode. If neither the first timer nor the second timer reaches the predetermined overflow limit (which indicates the presence of no lamps with both filaments intact), microcontroller 500 will not start the inverter 100 and heating circuit 300 (control signals 140, 141 and 142 remain at logic level of zero) and remain in a filament detection and monitoring mode (e.g., waiting for lamps to be inserted or replaced). The signal provided by inverter driver circuit 130 at auxiliary output 138 is used to control the filament heating provided by filament heating control circuit 300 and the filament heating circuitry (i.e., $L_{FS1}$,$L_{FS2}$,$L_{FS3}$ and diodes 230, 240,250) within output circuit 200; an example of this is described in further detail in the aforementioned U.S. patent application Ser. No. titled "Ballast with Lamp-Diagnostic Filament Heating, and Method Therefor."

It should be appreciated that a condition in which $V_B=K_2*V_{RAIL}$ (i.e., which occurs when only the second filament current path, including R3 and R4, is intact) is essentially ignored by microcontroller 500, and is treated in the same manner as a condition wherein no lamps with intact filaments are present. To ensure this functionality, it is important, as previously mentioned, that $K_2$ be chosen to be less than $K_1$.

Microcontroller 500 preferably includes an input 506 for monitoring the DC rail voltage, $V_{RAIL}$, as well as a current-sensing input 504 for monitoring the current that flows in filament heating control circuit 300. The provision of input 506 is useful in that it allows microcontroller 500 to effectively "track" the magnitude of $V_{RAIL}$; this capability is desirable because the filament detection function of microcontroller 500 is dependent upon the magnitude of $V_{RAIL}$, yet the magnitude of $V_{RAIL}$ is subject to certain variations during operation (due to, for example, a brown-out condition or an overvoltage condition at the AC power source). The functionality associated with current-sensing input 504 is discussed in further detail in the aforementioned U.S. patent application Ser. No. titled "Ballast with Lamp-Diagnostic Filament Heating, and Method Therefor."

Preferably, filament heating control circuit 300 comprises a first input 302, a second input 304, an electronic switch 310, a primary filament heating winding $L_{FP}$, a current-sensing resistor 318, a capacitor 320, and a diode 330. Electronic switch 310 is preferably realized as an N-channel field effect transistor (FET) having a gate 312, a drain 316, and a source 314. Gate 312 is coupled to second input 304. Capacitor 320 is coupled between first input 302 and a node 324. Diode 330 has an anode 332 coupled to first input 302 and a cathode 334 coupled to node 324. Primary filament heating winding LFP is coupled between node 324 and drain 316 of FET 310. Current-sensing resistor 318 is coupled between source 314 and circuit ground 80.

Preferably, as described in FIG. 2, filament heating control circuit 300 also includes a voltage clamping diode 340 having an anode 342 coupled to drain 316 (of FET 310) and a cathode 344 coupled to input terminal 102 of inverter 100.

Secondary filament heating windings $L_{FS1}$, $L_{FS2}$, and $L_{FS3}$ (located within output circuit 200) are magnetically coupled to primary filament heating winding $L_{FP}$, and provide filament heating voltages which are controlled by filament heating circuit 300. Within output circuit 200, diodes 230,240,250 are present in order to electrically isolate filament heating windings $L_{FS1}$,$L_{FS2}$,$L_{FS3}$ from the DC current paths (involving R1,R2,R3,R4 and the filaments 32,34,42,44 of lamps 30,40) that are used to ascertain the number of lamps with intact filaments that are coupled to the output connections of ballast 10.

A more detailed description of the operation of filament heating control circuit 300 is provided in the aforementioned U.S. patent application Ser. No. titled "Ballast with Lamp-Diagnostic Filament Heating, and Method Therefor."

The operation of ballast 10 is now described with reference to FIG. 2 as follows.

When both lamps 30,40 are present with both filaments of each lamp being intact, both the first and second filament current paths are intact; accordingly, both the first and second DC currents flow into the parallel circuit that includes DC blocking capacitor $C_B$ and voltage divider resistors 260,262. Consequently, the voltage $V_B$ (as defined and characterized above) across DC blocking capacitor $C_B$ will be at a first (i.e., relatively high) level; when only one lamp (with both filaments intact) is present, $V_B$ will be at a second (i.e., relatively low) level. Thus, the magnitude of $V_B$ prior to startup of the inverter is indicative of the number of functional lamps (i.e., lamps with intact filaments) that are connected to the output of ballast 10. Correspondingly, a scaled-down version of $V_B$—i.e., $V_X$—is conveyed to microcontroller 500. $V_X$ is interpreted by microcontroller 500 to determine whether or not lamps with intact filaments are present.

As described in FIG. 2, preferably, the resulting control signals (from outputs 510, 511 and 512 of microcontroller 500) are received by inverter driver circuit 130 (via inputs 140, 141 and 142) and are used to provide appropriate drive signals (via outputs 132,134,136 and 138) to inverter FETs 110 and 120 and to filament heating control circuit 300.

Figure 4A:
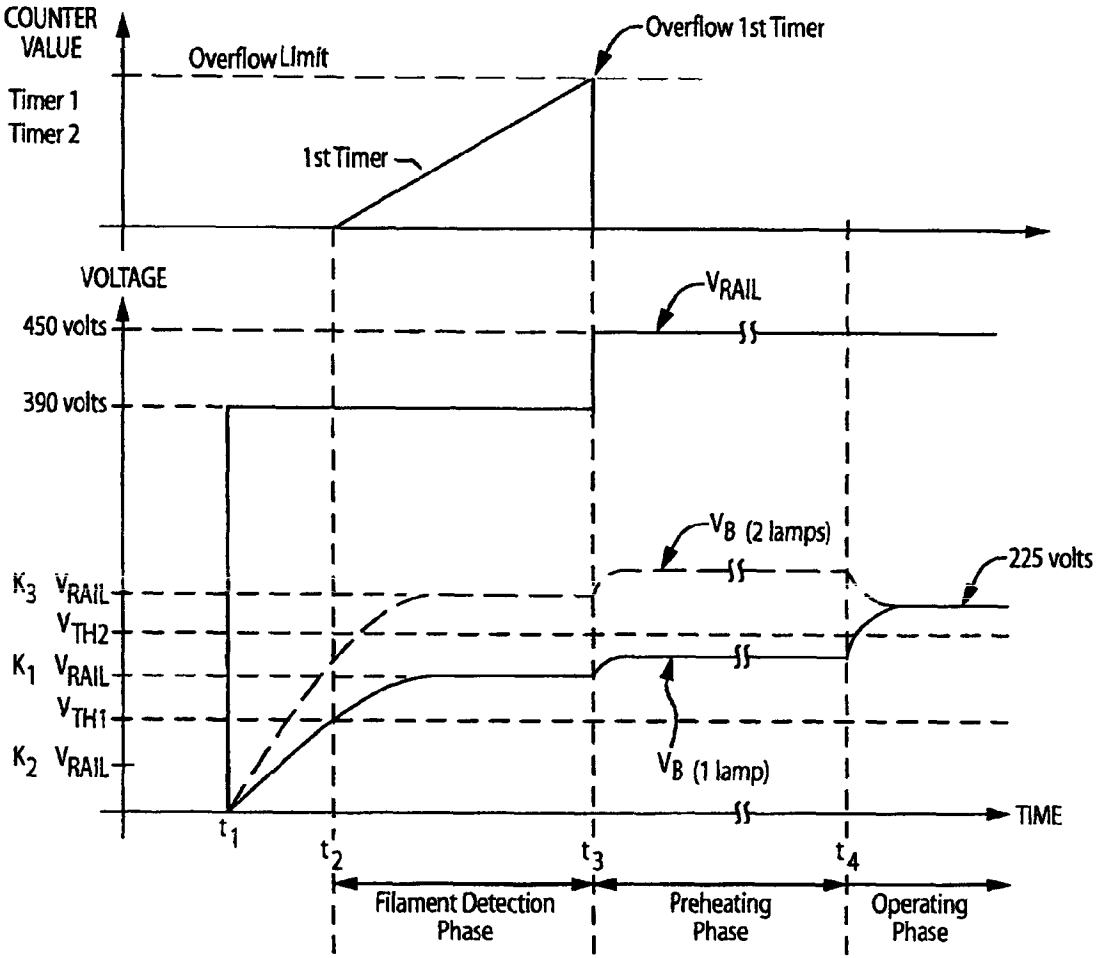
FIG. 4*a* describes a voltage across a DC blocking capacitor as a function of time in the arrangements depicted in FIGS. 2 and 3 for a single lamp, in accordance with a preferred embodiment of the present invention.
Figure 4B:
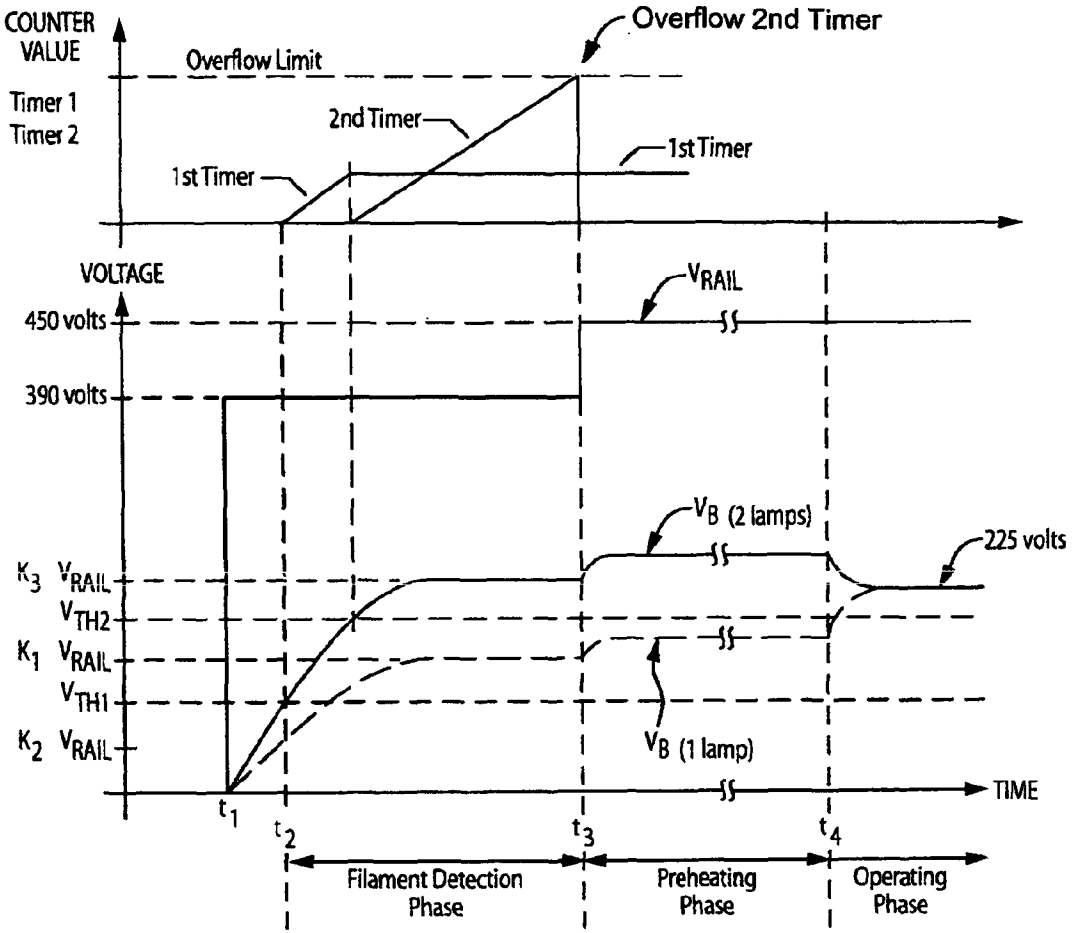
FIG. 4*b* describes a voltage across a DC blocking capacitor as a function of time in the arrangements depicted in FIGS. 2 and 3 for two lamps, in accordance with a preferred embodiment of the present invention.

A graphical description of the previously described functionality is provided in FIG. 4*a* for 1 lamp operation and FIG. 4*b* for 2 lamp operation, which illustrates approximate waveforms for $V_B$, $V_{RAIL}$ and timer values. $V_{TH1}$ and $V_{TH2}$ in FIG. 4*a* and FIG. 4*b* are to be understood as being proportional to $V_{X1}$ and $V_{X2}$, respectively.

Referring to FIG. 4*a*, AC power is initially applied to ballast 10 at time $t_1$. The DC rail voltage, $V_{RAIL}$, does not reach its steady-state operating value (e.g., about 450 volts) until power factor correction circuit and inverter 100 are started at time $t_3$. Prior to time $t_3$, $V_{RAIL}$ is at the peak of the AC line voltage (e.g., about 390 volts, for an AC power source voltage of 277 volts rms). Between time $t_1$ and time $t_3$, the voltage across DC blocking capacitor $C_B$ ramps up and eventually levels out. Until time $t_3$, which represents either first or second timer is reaching the predetermined overflow limit, microcontroller 500 is actively monitoring $V_X$ (which, as previously explained, is simply a scaled-down version of $V_B$). At time $t_2$ $V_B$ is crossing $V_{TH1}$ and the first timer is starting to be increased periodically. At time $t_3$, which signifies the beginning of the preheat phase, $V_{RAIL}$ transitions to its steady-state operating value (e.g., 450 volts) and microcontroller 500 starts to apply control signals to inverter 100 and filament control circuit 300 to provide preheating of the lamp filaments. At time $t_4$, the preheating phase is completed and an ignition voltage is applied for starting the lamps. Once the lamps ignite, the voltage $V_B$ across DC blocking capacitor $C_B$ transitions to a steady-state operating value that is approximately equal to one half of $V_{RAIL}$ (e.g., about 225 volts, when $V_{RAIL}$ is set at 450 volts). Subsequently (i.e., in the "operating phase" which occurs after time $t_4$), ballast 10 supplies operating power to the lamps. Control signal 512 of micro controller 500 is set to zero in operation mode to turn off filament heating in the preferred low cost embodiment. However, other embodiments of the invention may use an independent PWM generator to control the dutycycle of the logic level signal on output 512 of microcontroller 500 independent of the dutycycle of logic level signal 510 of microcontroller 500, thus allowing change to the heating of heating circuit 300 during normal operation to any desired level.

In FIG. 4*b*, the trace that is labeled "$V_B$ (2 lamps)" depicts the voltage, $V_B$, across DC blocking capacitor $C_B$ in the two-lamp arrangement described in FIG. 2 under a condition wherein all of the filaments 32,34,42,44 of lamps 30,40 are intact. The trace that is labeled "$V_B$ (1 lamp)" depicts the voltage, $V_B$, across DC blocking capacitor $C_B$ in the one-lamp arrangement described in FIG. 3 under a condition wherein both of the filaments 32,34 of lamp 30 are intact.

It should be appreciated that the trace labeled "$V_B$ (1 lamp)" in FIG. 4*a* is also representative of the voltage, $V_B$, across DC blocking capacitor $C_B$ that occurs in the two-lamp arrangement described in FIG. 2 under a condition wherein: (i) one or both of filaments 34,42 are not intact (i.e., the second filament current path, which includes R3 and R4, is open); and (ii) filaments 32,44 are both intact. However, as explained in further detail herein, this condition is treated as a lamp fault condition by associated protection circuitry within ballast 10, and is therefore of no consequence to the intended operation of microcontroller 500.

It should also be understood that there is a third possibility for $V_B$ that is not depicted in FIG. 4*a* or FIG. 4*b*. More particularly, in the two-lamp arrangement described in FIG. 2, and under a condition wherein filament 32 is open but the remaining filaments 34,42,44 are intact (i.e., the first filament path, including R1 and R2, is open, but the second filament path, including R3 and R4, is intact), $V_B$ will reach a magnitude that is less than $V_{TH1}$. As discussed in further detail herein, that condition is essentially ignored by microcontroller 500, and is effectively treated as a condition wherein no lamps with both filament intact are present (even though, in fact, both filaments 42,44 of lamp 40 may be intact).

The operation of ballast 10 in the two-lamp arrangement of FIG. 2 under various conditions (i.e., with respect to whether or not certain lamp filaments are intact) is described as follows.

Under a condition wherein filaments 32,34,42,44 of lamps 30,40 are all intact, both the first and second filament current paths are intact. Consequently, $V_B$ will equal $K_3*V_{RAIL}$, and will therefore exceed $V_{TH2}$ for at least most of the duration of the detection window between $t_2$ and $t_3$. In that case, by time $t_3$, the second timer within microcontroller 500 will have reached its predetermined overflow limit, thereby causing microcontroller 500 to select a prestored parameter set from the internal memory for configuring the inverter regulator firmware algorithms and the fault detection firmware algorithms that is representative of the fact that two lamps, each having both filaments intact, are coupled to the output connections of ballast 10.

Under a condition wherein filament 44 is open, and regardless of whether or not filaments 32,34,42 are intact, neither the first nor the second filament current paths, both of which include filament 44, are intact. Consequently, $V_B$ will remain at zero until lamp 40 is inserted or replaced with a new lamp with intact filament 44. In that case neither of the timers within microcontroller 500 will start counting and reach the predetermined overflow limit, thereby causing microcontroller 500 to select a parameter set so that the inverter does not enter preheat mode. As previously mentioned, safety concerns dictate that a condition in which filament 44 is open should be treated in a special manner, even when both filaments 32,34 of lamp 30 are intact.

Under a condition wherein either one of filaments 34,42 is open, and irrespective of whether the remaining filaments 32,44 are intact, the second filament current path (which includes R3 and R4) is open (i.e., not intact). Consequently, $V_B$ will be limited, prior to inverter startup, to a value that is no greater than $K_1*V_{RAIL}$. Under these conditions, $V_B$ will reach $K_1*V_{RAIL}$ during the detection period only if filaments 32,44 are both intact, in which case $V_B$ will exceed $V_{TH1}$, but not $V_{TH2}$. From the point of view of microcontroller 500, this condition will appear to be the same as the one-lamp arrangement (with both filaments of the single lamp being intact) depicted in FIG. 3. However, with the second filament current path being open, neither of the two lamps 30,40 will receive heating of their associated filaments 32,44, and will therefore not ignite and/or operate in a normal manner; that being the case, lamp heating circuitry 300 within ballast 10 will be configured and controlled by firmware of microcontroller 500 as if only one lamp with functional filaments would be present.

To summarize, in the two-lamp arrangement described in FIG. 2, the parameter set selected by microcontroller 500 to control inverter 100, heating circuit 300 and to configure fault detection circuitry may assume one of several different values, depending upon the conditions (i.e., intact or open) of lamp filaments 32,34,42,44. More specifically, the generation of the control signals 510,511,512 is configured at: (i) a first value-array (e.g., on-time 1, deadtime 1, frequency 1, fault condition thresholds 1) in response to a condition wherein timer 1 is overflowing; (ii) a second value-array (e.g., on-time 2, deadtime 2, frequency 2, fault condition thresholds 2) in response to a condition wherein second timer is overflowing;

FIG. 3 describes an alternative application in which ballast 10 is utilized to power a single lamp 30. First and second output connections 202,204 are adapted for coupling to a first filament 32 of lamp 30. Fifth and sixth output connections 210,212 are adapted for coupling to a second filament 34 of lamp 30. In the one-lamp arrangement of FIG. 3, third and fourth output connections 206,208 are not utilized, and there is only a single filament current path (which includes R1 and R2). Consequently, resistances R3 and R4 serve no meaningful function in the operation of ballast 10 in the one-lamp arrangement depicted in FIG. 3.

The operation of ballast 10 in the one-lamp arrangement of FIG. 3 under various conditions (i.e., with respect to whether or not certain lamp filaments are intact) is described as follows.

Under a condition wherein both filaments 32,34 are intact, the single filament current path is intact. Consequently, $V_B$ will exceed $V_{TH1}$ but will remain below $V_{TH2}$ because the second filament current path (i.e., including R3 and R4) is open. In that case, by time $t_3$, the first timer within microcontroller 500 will have reached its predetermined overflow limit, thereby causing microcontroller 500 to select a prestored parameter set from the internal memory for configuring the inverter regulator firmware algorithms and the fault detection firmware algorithms that is representative of the fact that both filaments 32,34 of the single lamp 30 are intact.

Under a condition wherein either one or both of filaments 32,34 are not intact, the single filament current path will be open. Consequently, $V_B$ will be at zero, and microcontroller 500 will interpret that as signifying that no lamp with both filaments intact is present.

To summarize, in the one-lamp arrangement described in FIG. 3, the generation of the control signals 510,511,512 is configured at the first value-array (e.g., on-time 1, deadtime 1, frequency 1, fault condition thresholds 1) in response to a condition wherein timer 1 is overflowing.

In this way, ballast 10 operates in arrangements including a single lamp or multiple lamps to detect the presence of lamps with intact filaments. As previously described, this detection may be used for any of a number of useful purposes, such as for providing appropriate levels of filament heating and/or for setting thresholds used in detecting lamp fault conditions.

Although the present invention has been described with reference to certain preferred embodiments, numerous modifications and variations can be made by those skilled in the art without departing from the novel spirit and scope of this invention. For example, although the preferred embodiments described herein have specifically described arrangements involving two lamps and a single lamp, it should be appreciated that the principles of the present invention may be readily adapted and applied to ballasts for powering three or more lamps. As another example, a separate driver circuit for FET 310 could be employed instead of sharing the one driver circuit for the three FETs denoted by reference numerals 110, 120, and 310. As another example a more sophisticated microcontroller 500 with additional PWM modules could be used to control the dutycycle of inverter input 142 independent of inverter input 140 thus allowing for heating filaments of lamps 30 and 32 also during regular operation at any desired level rather than having only on/off capability for control during normal operation mode.

What is claimed is:

1. A ballast for powering a lamp load comprising at least one gas discharge lamp having a pair of lamp filaments, the ballast comprising:

an inverter;

an output circuit coupled to the inverter, the output circuit comprising a plurality of output connections adapted for coupling to the at least one gas discharge lamp; and a control circuit coupled to the output circuit and to the inverter, wherein the control circuit is operable, during a detection period prior to startup of the inverter:

(i) in an arrangement wherein the lamp load includes only a single lamp, to detect whether or not the single lamp has both filaments intact; and (ii) in an arrangement wherein the lamp load includes multiple lamps, to detect whether or not all of the lamps have both filaments intact; and wherein the control circuit includes:

(i) a filament detection input coupled to the output circuit; and (ii) at least a first control output coupled to the inverter; and the control circuit is further operable:

(i) during the detection period prior to startup of the inverter, to receive at the filament detection input a voltage signal from the output circuit that is indicative of whether or not intact lamp filaments are connected to the output connections; and (ii) to provide a control signal at the first control output in dependence upon the voltage signal; and the control circuit provides a first timing function and a second timing function; and the control circuit is further operable:

(a) in response to the voltage signal at the filament detection input exceeding a first predetermined threshold, to start a first timer, and then to periodically increment the first timer until such time as: (i) the voltage signal exceeds a second predetermined threshold; or (ii) the first timer reaches a predetermined overflow limit; and (b) in response to the voltage signal at the filament detection input exceeding the second predetermined threshold, to: (i) stop the first timer, if the first timer had previously started; (ii) start a second timer; and (iii) periodically increment the second timer until such time as the second timer reaches the predetermined overflow limit.

2. The ballast of claim 1, wherein:

the plurality of output connections comprises first, second, third, fourth, fifth, and sixth output connections:

for a two-lamp arrangement wherein the lamp load consists of two lamps:

the first and second output connections are adapted for coupling to a first filament of a first lamp;

the third and fourth output connections are adapted for coupling to a second filament of the first lamp and a first filament of a second lamp;

the fifth and sixth output connections are adapted for coupling to a second filament of the second lamp; and the two-lamp arrangement includes a plurality of filament current paths, comprising:

a first filament current path that includes the first filament of the first lamp and the second filament of the second lamp; and a second filament current path that includes the second filament of the first lamp, the first filament of the second lamp, and the second filament of the second lamp; and for a one-lamp arrangement wherein the lamp load consists of one lamp:

the first and second output connections are adapted for coupling to a first filament of the lamp;

the fifth and sixth output connections are adapted for coupling to a second filament of the lamp; and the one-lamp arrangement includes a filament current path that includes the first and second filaments of the lamp.

3. The ballast of claim 1, wherein the control circuit is further operable:

(a) in response to the first timer reaching the predetermined overflow limit, to set the control signal at a first value; and (b) in response to the second timer reaching the predetermined overflow limit, to set the control signal at a second value.

4. The ballast of claim 3, wherein the control circuit is realized by a microcontroller.

5. The ballast of claim 3, wherein the inverter includes an inverter driver circuit, the inverter driver circuit including:

at least one input coupled to the at least one control output of the control circuit; and at least one output, wherein the inverter driver circuit is operable to provide a signal at the at least one output in dependence upon the control signal provided by the control circuit to the at least one input of the inverter driver circuit.

6. The ballast of claim 1, wherein:

the inverter comprises:

first and second input terminals adapted to receive a source of substantially direct current (DC) voltage;

an inverter output terminal;

a first inverter switch coupled between the first input terminal and the inverter output terminal;

a second inverter switch coupled between the inverter output terminal and a circuit ground; and an inverter driver circuit operable to provide substantially complementary commutation of the first and second inverter switches, the inverter driver circuit including an at least one input and a plurality of outputs, wherein the plurality of outputs includes at least a first output coupled to the first inverter switch, a second output coupled to the inverter output terminal, and a third output coupled to the second inverter switch;

the plurality of output connections includes first, second, third, fourth, fifth, and sixth output connections; and the output circuit further comprises:

a resonant inductor coupled between the inverter output terminal and a first node;

a resonant capacitor coupled between the first node and circuit ground, wherein circuit ground is coupled to the second input terminal of the inverter;

a direct current (DC) blocking capacitor coupled between the sixth output connection and circuit ground;

a first resistance coupled between the first input terminal of the inverter and the first output connection; and a second resistance coupled between the second and fifth output connections; and a third resistance coupled between the first input terminal of the inverter and the third output connection; and a fourth resistance coupled between the fourth and fifth output connections.

7. The ballast of claim 6, wherein:

for an arrangement wherein the lamp load consists of two lamps:

the first and second output connections are coupled to a first filament of a first lamp;

the third and fourth output connections are coupled to a second filament of the first lamp and to a first filament of a second lamp; and the fifth and sixth output connections are coupled to a second filament of the second lamp; and for an arrangement wherein the lamp load consists of one lamp:

the first and second output connections are coupled to a first filament of the lamp; and the fifth and sixth output connections are coupled to a second filament of the lamp.

8. The ballast of claim 6, wherein the control circuit comprises:

a filament detection input operably coupled to the DC blocking capacitor; and a plurality of control outputs coupled to the inverter driver circuit.

9. The ballast of claim 8, wherein the control circuit comprises a microcontroller.

10. The ballast of claim 8, wherein the output circuit further comprises a voltage divider network comprising:

a first voltage divider resistor coupled between the sixth output connection and the filament detection input of the control circuit; and a second voltage divider resistor coupled between the filament detection input of the control circuit and circuit ground.

11. The ballast of claim 8, wherein the control circuit further comprises a DC rail monitoring input that is operably coupled to the first input terminal of the inverter.

12. A ballast for powering a lamp load comprising at least one gas discharge lamp having a pair of lamp filaments, the ballast comprising:

an inverter, comprising:

first and second input terminals for receiving a source of substantially direct current (DC) voltage;

an output terminal;

first and second inverter switches coupled to the input terminals and to the output terminal; and an inverter driver circuit coupled to the first and second inverter switches, the inverter driver circuit including at least one input;

an output circuit coupled to the inverter, comprising:

a plurality of output connections, comprising first, second, third, fourth, fifth, and sixth output connections;

a direct current (DC) blocking capacitor coupled between the sixth output connection and circuit ground; and at least one filament current path by which, prior to startup of the inverter, a DC current may flow from the first input terminal of the inverter, through the filaments of the at least one lamp, and into the DC blocking capacitor;

a control circuit, comprising:

a voltage detection input operably coupled to the DC blocking capacitor; and at least one control output coupled to the at least one input of the inverter driver circuit; and wherein the control circuit is operable:

(i) to receive, at the voltage detection input, a voltage signal that is representative of a voltage across the DC blocking capacitor prior to inverter startup and that is indicative of whether or not the at least one filament current path is intact; and (ii) to provide, at the control output, an output signal in accordance with the voltage signal received at the voltage detection input; and wherein the lamp load comprises a first lamp and a second lamp;

the first and second output connections are adapted for coupling to a first filament of the first lamp;

the third and fourth output connections are adapted for coupling to a second filament of the first lamp and a first filament of the second lamp, wherein the second filament of the first lamp and first filament of the second lamp are connected in series between the third and fourth output connections;

the fifth and sixth output connections are adapted for coupling to a second filament of the second lamp;

the ballast includes first and second filament current paths, wherein the first filament current path includes the first filament of the first lamp and the second filament of the second lamp, and the second filament current path includes the second filament of the first lamp, the first filament of the second lamp, and the second filament of the second lamp; and the control circuit is operable:

(a) to detect, during a detection period prior to startup of the inverter, whether or not: (i) both the first and second filament current paths are intact; and (ii) only the first filament current path is intact; and (b) to set the output signal at the at least one control output: (i) to a first value in response to both the first and second filament current paths being intact; and (ii) to a second value in response to only the first filament current path being intact; and wherein the output circuit further includes a plurality of resistances, comprising:

a first resistance coupled between the first input terminal of the inverter and the first output connection;

a second resistance coupled between the second and fifth output connections;

a third resistance coupled between the first input terminal of the inverter and the third output connection; and a fourth resistance coupled between the fourth and fifth output connections.

13. The ballast of claim 12, wherein the control circuit includes a microcontroller having a first timer function and a second timer function, wherein the microcontroller is operable:

(a) in response to the voltage signal at the filament detection input exceeding a first predetermined threshold, to start a first timer, and then to periodically increment the first timer until such time as: (i) the voltage signal exceeds a second predetermined threshold; or (ii) the first timer reaches a predetermined overflow limit;

(b) in response to the voltage signal at the filament detection input exceeding the second predetermined threshold, to: (i) stop the first timer, if the first timer had previously started; (ii) start a second timer; and (iii) periodically increment the second timer until such time as the second timer reaches the predetermined overflow limit;

(c) in response to the first timer reaching the predetermined overflow limit, to set the control signal at a first value; and (d) in response to the second timer reaching the predetermined overflow limit, to set the control signal at a second value.

14. The ballast of claim 12, wherein:

the lamp load comprises a single lamp;

the first and second output connections are adapted for coupling to a first filament of the lamp;

the fifth and sixth output connections are adapted for coupling to a second filament of the lamp;

the ballast includes a filament current path that includes the first and second filaments of the lamp; and the control circuit is operable:

(a) to detect, during a detection period prior to startup of the inverter, whether or not the filament current path is intact; and (b) to set the output voltage at the at least one control output to a first value in response to the filament current path being intact.

15. The ballast of claim 14, wherein the output circuit further includes a plurality of resistances, comprising:

a first resistance coupled between the first input terminal of the inverter and the first output connection; and a second resistance coupled between the second and fifth output connections.

16. A ballast for powering a lamp load comprising at least one gas discharge lamp, the ballast comprising:

an inverter, comprising:

first and second input terminals adapted to receive a source of substantially direct current (DC) voltage;

an inverter output terminal;

a first inverter transistor coupled between the first input terminal and the inverter output terminal;

a second inverter transistor coupled between the inverter output terminal and circuit ground; and an inverter driver circuit coupled to the first and second inverter transistor, the inverter driver circuit including at least one input;

an output circuit, comprising:

first, second, third, fourth, fifth, and sixth output connections adapted for coupling to the lamp load, wherein:

(i) in an arrangement for powering two lamps, the first and second output connections are coupled to a first filament of a first lamp, the third and fourth output connections are coupled to a second filament of the first lamp and a first filament of a second lamp, and the fifth and sixth output connections are coupled to a second filament of the second lamp; and (ii) in an arrangement for powering a single lamp, the first and second output connections are coupled to a first filament of the single lamp, and the fifth and sixth output connections are coupled to a second filament of the single lamp;

a resonant inductor coupled between the inverter output terminal and a first node;

a resonant capacitor coupled between the first node and circuit ground, wherein circuit ground is coupled to the second input terminal of the inverter;

a direct current (DC) blocking capacitor coupled between the sixth output connection and circuit ground;

a first resistance coupled between the first input terminal of the inverter and the first output connection; and a second resistance coupled between the second and fifth output connections; and a third resistance coupled between the first input terminal of the inverter and the third output connection; and a fourth resistance coupled between the fourth and fifth output connections;

a control circuit, comprising:

a filament detection input operably coupled to the DC blocking capacitor; and at least one control output coupled to the at least one input of the inverter driver circuit; and wherein the control circuit is operable to provide a control signal at the at least one control output, the control signal having characteristics that are dependent upon the conditions of the lamp filaments, such that:

(a) in the arrangement for powering two lamps, the characteristics of the control signal are set at: (i) a first value in response to the second filament of the second lamp not being intact; (ii) a second value in response to the second filament of the first lamp and the first and second filaments of the second lamp being intact, but the first filament of the first lamp not being intact; (iii) a third value in response to the first filament of the first lamp and the second filament of the second lamp being intact, but at least one of the second filament of the first lamp and the first filament of the second lamp not being intact; and (iv) a fourth value in response to both filaments of both lamps being intact; and (b) in the arrangement for powering a single lamp, the characteristics of the control signal are set at: (i) the first value in response to at least one filament of the single lamp not being intact; and (ii) the third value in response to both filaments of the single lamp being intact.

* * * * *